US008297468B1

(12) United States Patent
DeLay

(10) Patent No.: US 8,297,468 B1
(45) Date of Patent: Oct. 30, 2012

(54) FUEL TANK FOR LIQUEFIED NATURAL GAS

(75) Inventor: Thomas K. DeLay, Huntsville, AL (US)

(73) Assignee: The United States of America as Represented by the Administrator of the National Aeronautics and Space Administration, Washington, DC (US)

( * ) Notice: Subject to any disclaimer, the term of this patent is extended or adjusted under 35 U.S.C. 154(b) by 2610 days.

(21) Appl. No.: 10/857,380

(22) Filed: May 20, 2004

(51) Int. Cl.
*F17C 1/12* (2006.01)
*F17C 1/14* (2006.01)

(52) U.S. Cl. ..... 220/581; 220/560.12; 220/560.15; 220/586; 220/592.25

(58) Field of Classification Search ..... 220/581, 220/560.12, 560.15, 562, 586, 588, 590, 220/592.25, 62.19
See application file for complete search history.

(56) References Cited

U.S. PATENT DOCUMENTS 5,476,189 A * 12/1995 Duvall et al. ..... 220/590
5,822,838 A 10/1998 Seal et al.
6,074,595 A 6/2000 Eisberg et al.
6,193,917 B1 2/2001 DeLay
6,401,963 B1 6/2002 Seal et al.
6,418,962 B1 7/2002 Wozniak et al.
6,425,172 B1 7/2002 Rutz
6,460,721 B2 10/2002 Bowen et al.
6,651,307 B2 * 11/2003 Portmann ..... 29/452
RE38,433 E * 2/2004 Seal et al. ..... 29/469.5
2002/0053573 A1 5/2002 Bowen et al.
2005/0001100 A1 * 1/2005 Hsi-Wu et al. ..... 244/158 R
2005/0089661 A1 * 4/2005 Hogenson et al. ..... 428/36.5
2006/0011235 A1 * 1/2006 Bishop et al. ..... 137/259

* cited by examiner

*Primary Examiner* — Mickey Yu
*Assistant Examiner* — Niki Eloshway
(74) *Attorney, Agent, or Firm* — Ross F. Hunt, Jr.; James J. McGroary

(57) ABSTRACT

A storage tank is provided for storing liquefied natural gas on, for example, a motor vehicle such as a bus or truck. The storage tank includes a metal liner vessel encapsulated by a resin-fiber composite layer. A foam insulating layer, including an outer protective layer of epoxy or of a truck liner material, covers the composite layer. A non-conducting protective coating may be painted on the vessel between the composite layer and the vessel so as to inhibit galvanic corrosion.

12 Claims, 1 Drawing Sheet

FUEL TANK FOR LIQUEFIED NATURAL GAS

ORIGIN OF THE INVENTION

This invention was made by employees of the United States Government and may be manufactured and used by or for the Government for governmental purposes without the payment of any royalties.

FIELD OF THE INVENTION

This invention relates to holding vessels or fuel tanks for liquefied natural gas for use on automobiles, busses and other motor vehicles.

BACKGROUND OF THE INVENTION AND RELATED ART

There has been an increased interest in the use of liquefied natural gas (LNG) both because of potential fuel gas savings and because of environmental concerns with existing fuels. LNG is of particular interest for busses because of the range of travel required of busses.

More fuel can be stored when the fuel is in a liquefied state but effective storing of LNG presents particular problems. Current LNG storage systems actually in use on automotive vehicles employ fuel tanks that are very heavy, complex and expensive. State-of-the-art tank systems are of a Dewar type and comprise a stainless steel tank disposed inside of a further steel tank with vacuum between the two tanks. The tank system is maintained at a low pressure (about 150 psi) and also requires a pumping assembly to maintain the vacuum between the two steel tanks.

Other tanks for the storage of LNG have been proposed. U.S. Patent Publication No. 2002/0053573 to Bowen et al discloses a storage container or vessel for natural gas made from a composite material and including a non-load bearing liner in contact with the vessel. The composite material is comprised of high performance fibers (such as E-glass, S-glass aramid, carbon and KEVLAR® fibers, as well as others including silicon carbide fibers, boron filaments and ultra-high molecular weight polyethylene fibers). The liner is made from a substantially impermeable material or materials, such as metallic foil, a synthetic polymer film, a combination of a metallic foil on a thin polymeric film, a metal coated polymer substrate and laminate of a metallic liner sandwiched between polymeric layers.

U.S. Pat. No. 6,460,721 to Bowen et al also discloses a container for storing pressurized liquefied natural gas (PLNG). The container comprises a composite vessel made of fibers (e.g., carbon, glass or a hybrid of carbon and glass) embedded in a cryogenic epoxy matrix, and a liner made of a substantially impermeable material (e.g., seamless aluminum) which provides a barrier for the PLNG stored in the container. An outer polyurethane coating is also provided.

U.S. Pat. No. 6,401,963 to Seal et al discloses a composite overwrapped pressure vessel including a liner made of titanium and a composite overwrap bonded by an adhesive to the liner, and including a protective epoxy coating over the overwrap, e.g., a filament-wound graphite epoxy overwrap.

In a commonly assigned U.S. Pat. No. 6,193,917 to the present inventor (Delay), a composite tank is coated with a nickel coating and wrapped with graphite fibers wetted with an epoxy resin. The resin is cured and a layer of insulating foam is then applied and cured.

SUMMARY OF THE INVENTION

In accordance with one aspect of the invention, there is provided a holding tank or vessel for holding liquefied natural gas which is relatively inexpensive to produce and operate, and which is also very light in weight. The vessel can also be used with high pressure gaseous fuels so that the vessel is quite versatile for refueling options. The vessel also conserves the fuel by reducing the need to vent off gases due to pressure changes as the liquefied fuel changes to a gas. The vessel is quite simple from a systems viewpoint as compared with the prior art in that no elaborate refrigeration systems or vacuum pumps are required. Further, the vessel or tank is easily modified to accommodate the particular requirements of a user.

According to one aspect of the invention, there is provided a storage tank for storing liquefied natural gas, the storage tank comprising:

a metal liner vessel;

a resin-fiber composite layer covering the liner vessel;

an insulating layer covering the composite layer on the liner vessel; and an outer protective layer covering the insulating layer.

The storage tank preferably further comprises a non-conducting protective coating on the vessel between the composite layer and the vessel.

Advantageously, the liner vessel comprises a seamless aluminum vessel.

Preferably, the composite layer comprises a plurality of graphite fibers embedded in an epoxy matrix.

The insulating layer preferably comprises a foam insulation layer, and, more preferably, the foam insulation layer comprises polyurethane foam.

In one preferred implementation, the outer protective layer comprises an epoxy resin coating layer, and in an alternative preferred implementation, the outer protective layer comprises a layer of a polyurethane/polyurea copolymer.

Advantageously, the non-conducting protective coating comprises a non-conducting paint applied to the vessel.

According to a further aspect of the invention, there is provided, in combination, a motor vehicle including an engine fueled by liquefied natural gas, and a storage tank located on the vehicle for storing liquefied natural gas for use by the vehicle engine, the storage tank comprising:

a metal liner vessel;

a resin-fiber composite layer covering the liner vessel;

a non-conducting protective coating on said vessel between the composite layer and the vessel;

a foam insulating layer covering the composite layer on the liner vessel; and an outer protective layer covering the foam insulating layer.

As above, the liner vessel advantageously comprises a seamless aluminum vessel.

Preferably, the composite layer comprises a plurality of graphite fibers embedded in an epoxy matrix.

The insulating layer preferably comprises a foam insulation layer, and the foam insulation layer comprises polyurethane foam.

As above, in one preferred implementation, the outer protective layer comprises an epoxy resin coating layer, while in an alternative embodiment, the outer protective layer comprises a layer of a polyurethane/polyurea copolymer.

The non-conducting protective coating preferably comprises a non-conducting paint applied to said vessel.

Further features and advantages of the present invention will be set forth in, or apparent from, the detailed description of preferred embodiments thereof which follows.

DESCRIPTION OF THE PREFERRED EMBODIMENTS

Figure 1:
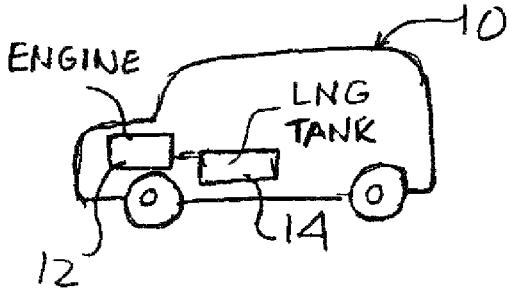
FIG. 1 is a highly schematic side elevational view of a motor vehicle including a LNG tank.

Referring to FIG. 1, there is shown a highly schematic representation of a motor vehicle, in this case, a bus 10, having an engine 12 supplied with liquefied natural gas from a LNG storage tank or vessel 14. As indicated above, while the present invention is not limited to such an application, the invention provides particular advantages when incorporated in a motor vehicle such as bus 10. These advantages were mentioned above and are discussed in more detail below.

Figure 2:
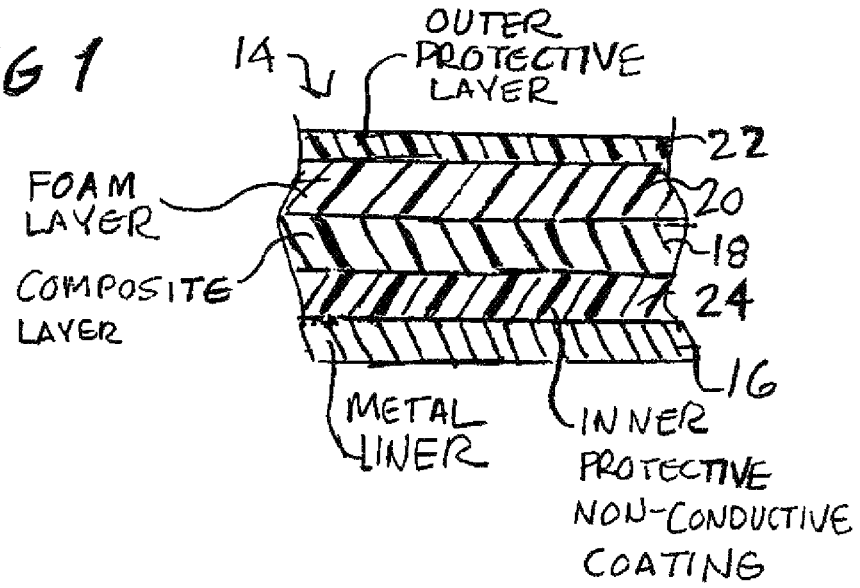
FIG. 2 is a broken away, cross sectional view of a portion of a wall of the LNG tank of FIG. 1, constructed in accordance with a preferred embodiment of the invention.

Referring to FIG. 2, there is shown a cross sectional view of a wall of storage tank or vessel 14 of FIG. 1. As illustrated, the tank 14 includes a metallic liner 16 and, in a preferred embodiment, is formed by a seamless aluminum tank. Such aluminum tanks are conventional per se and one commercial tank is that manufactured by Samtech, Inc.

The liner 16 of tank 14 has a composite layer 18 formed thereon, and in a preferred embodiment, composite layer 18 is filament wound. In a more preferred embodiment, composite layer 18 includes M30 carbon fibers and PBO (e.g., ZYLON®) fibers embedded in an epoxy, although other graphite fibers and other fibers can be used.

In accordance with one important feature of the invention, the composite over-wrapped vessel formed by liner 16 and composite layer 18 is covered by a layer 20 of an insulating material. Insulating layer 20 is preferably made of polyurethane which is sprayed onto layer 18 and which is thereafter machined into the desired shape. A protective coating or layer 22 covers insulating layer 20. Coating 22 provides impact protection for the insulating foam layer 20 as well as environmental protection. In one preferred embodiment, coating 22 comprises a thin layer of a ductile epoxy resin which is applied to machined foam layer 20 by, e.g., brushing coating 22 onto foam layer 20. In an alternative embodiment, foam layer 20 is a sprayed-on polyurethane/polyurea copolymer coating or lining such as is used as a truck bed lining. A commercial truck bed lining such as "Line-X" can be used for this purpose.

In a preferred embodiment, liner 16 is coated or covered with an outer layer 24 of a non-conductive protective material such as a non-conductive paint. This prevents the conductive, e.g., carbon, fibers of composite layer 18 from being in intimate contact with liner tank or vessel 16, thereby reducing the likelihood of galvanic corrosion.

Although the invention has been described above in relation to preferred embodiments thereof, it will be understood by those skilled in the art that variations and modifications can be effected in these preferred embodiments without departing from the scope and spirit of the invention.

What is claimed is:

1. A storage tank for storing liquefied natural gas, said storage tank comprising:

a metal liner vessel;

a resin-fiber composite layer covering the liner vessel;

a sprayed-on polyurethane foam insulating layer covering the composite layer on the liner vessel; and a sprayed-on outer protective layer covering the insulating layer, said outer protective layer comprising a polyurethane/polyurea copolymer.

2. A storage tank as claimed in claim 1 further comprising:

a non-conducting protective coating on said vessel between the composite layer and the vessel.

3. A storage tank as claimed in claim 2 wherein said non-conducting protective coating comprises a non-conducting paint applied to said vessel.

4. A storage tank as claimed in claim 1 wherein said liner vessel comprises a seamless aluminum vessel.

5. A storage tank as claimed in claim 1 wherein said composite layer comprises a plurality of graphite fibers embedded in an epoxy matrix.

6. In combination, an automotive motor vehicle including an engine fueled by liquefied natural gas, and a storage tank located on the vehicle for storing liquefied natural gas for use by the vehicle engine, said storage tank comprising:

a metal liner vessel;

a resin-fiber composite layer covering the liner vessel;

a non-conducting protective coating on said vessel between the composite layer and the vessel;

a sprayed-on foam insulating layer covering the composite layer on the liner vessel; and a sprayed-on outer protective polyurethane/polyurea copolymer layer covering the foam insulating layer.

7. A storage tank as claimed in claim 6 wherein said liner vessel comprises a seamless aluminum vessel.

8. A storage tank as claimed in claim 6 wherein said composite layer comprises a plurality of graphite fibers embedded in an epoxy matrix.

9. A storage tank as claimed in claim 6 wherein said insulating layer comprises a foam insulation layer.

10. A storage tank as claimed in claim 6 wherein said foam insulation layer comprises polyurethane foam.

11. A storage tank as claimed in claim 6 wherein said non-conducting protective coating comprises a non-conducting paint applied to said vessel.

12. A storage tank for storing liquefied natural gas, said storage tank comprising:

a metal liner vessel;

a resin-fiber composite layer covering the liner vessel;

a non-conducting protective coating on said vessel between the composite layer and the vessel, said protective coating comprising a non-conductive paint;

a sprayed-on polyurethane foam insulating layer covering the composite layer on the liner vessel; and a sprayed-on outer protective layer covering the insulating layer, said outer protective layer comprising a polyurethane/polyurea copolymer.

* * * * *